US005720577A

United States Patent [19]

Sanders et al.

[11] Patent Number: 5,720,577

[45] Date of Patent: Feb. 24, 1998

[54] BOX CULVERT

[75] Inventors: Darrell J. Sanders, Springboro, Ohio; Allan P. Schoulties, Highland Heights, Ky.

[73] Assignee: Contech Constructions Products Inc., Middletown, Ohio

[21] Appl. No.: 541,046

[22] Filed: Oct. 11, 1995

[51] Int. Cl.[6] ..... E01F 5/00

[52] U.S. Cl. ..... 405/124; 52/86; 52/274; 52/293.3; 405/125; 405/126

[58] Field of Search ..... 405/124, 125, 405/126; 52/293.1, 293.3, 274, 86, 88, 126

[56] References Cited

U.S. PATENT DOCUMENTS

| | | | |
|---|---|---|---|
| 905,290 | 12/1908 | Cummings et al. | 405/126 |
| 1,203,656 | 11/1916 | Shannon . | |
| 1,926,843 | 9/1933 | Fischer . | |
| 1,928,480 | 9/1933 | Carswell et al. | 405/124 |
| 2,073,185 | 3/1937 | Shafer | 52/293.3 |
| 2,126,091 | 8/1938 | Claybaugh | 405/124 |
| 3,727,358 | 4/1973 | Howell | 52/274 X |
| 4,141,666 | 2/1979 | DeGraff . | |
| 4,318,635 | 3/1982 | Gurtner et al. . | |
| 4,650,369 | 3/1987 | Thomas et al. . | |
| 5,326,191 | 7/1994 | Wilson et al. . | |

FOREIGN PATENT DOCUMENTS

| | | | |
|---|---|---|---|
| 0023969 | 2/1981 | European Pat. Off. | 52/86 |
| 3415206 | 10/1985 | Germany | 52/86 |

OTHER PUBLICATIONS

Drawings, Kaiser Aluminum & Chemical Sales, Inc., Oakland, CA, Highway Products Division.

Brochure, "Aluminum Box Culvert", Contech Construction Products, Inc., Middletown, Ohio, ©1994.

*Primary Examiner*—Dennis L. Taylor

*Attorney, Agent, or Firm*—Wood, Herron & Evans, L.L.P.

[57] ABSTRACT

A box culvert formed from a plurality of corrugated sections. Reinforcing ribs are secured to the outside surface of the culvert. A universal receiving channel is provided for each lower edge of the culvert and may be used to secure lower edge portions extending at different angles relative to horizontal. A rib configuration is disclosed which results in manufacturing and material savings.

20 Claims, 2 Drawing Sheets

BOX CULVERT

BACKGROUND OF THE INVENTION

The present invention generally relates to culvert structures and, more specifically, to low head room culvert structures made up of a series of shallow arch-shaped corrugated sections secured together and secured to base receiving channels.

The culvert structure of the present invention incorporates improvements over culvert structures of the past, such as the one disclosed in U.S. Pat. No. 4,141,666 issued in the name of DeGraff, the disclosure of which is hereby incorporated by reference herein. The DeGraff patent discloses a culvert structure having a plurality of corrugated curved sections secured together and secured into a base receiving angle as shown in FIG. 2 of that patent. This patent further discloses a series of outer reinforcing ribs which are likewise curved to conform to the outer surface of the culvert.

Box culverts or low head room culverts have found success in the marketplace as they are generally faster and easier to install than, for example, cast in place concrete. No forms or curing time is necessary and large installation crews are likewise unnecessary. In addition, box culverts use more mass produced, standard components, and therefore material costs are generally lower than with alternative structures. For these reasons and others, box culverts have provided practical and cost efficient solutions for such applications as small bridge replacement.

Despite the success of conventional box culvert structures, the areas of component standardization and material costs are of continuing concern and in need of improvement. Specifically, the receiving angles used in the past for box culverts commercialized by the assignee of the present invention have been required to accommodate box culverts having side walls extending upwardly at various angles to horizontal. As a result, two different receiving channels have been manufactured and stocked, each being generally L-shaped but one being angled at 90° and one being angled at 80°. The manufacture and stocking of two separate parts increases the overall material and inventory costs.

Another problem related to standardization of components and material costs concerns the attachment and configuration of reinforcement ribs on the separate corrugated sections which form the overall box culvert structure. With reference to FIG. 3, culvert sections 10 have been assembled with reinforcement ribs 12 bolted to the outer surface by nut and bolt assemblies 14 and spaced from each other by, for example, 18 inches. Also, a series of bolt holes 16 were punched along opposite side edges 18 of section 10 to receive nut and bolt assemblies (not shown) for securing adjacent culvert sections to each other. These bolt holes were spaced about nine inches from the adjacent reinforcement ribs 12. Thus, when additional culvert sections 10 were attached along edges 18 of section 10, the ribs of adjacent sections were likewise spaced 18 inches apart. Although this system allowed the stocking of standard components, i.e., sections 10, it required numerous relatively expensive heavy duty nut and bolt assemblies for bolting ribs 12 to sections 10, as well as for separately bolting adjacent sections 10 together along edges 18.

It would therefore be desirable to even further standardize the components making up box culvert structures and to further reduce the numbers of components and material costs associated with such culverts.

SUMMARY OF THE INVENTION

The present invention generally provides improvements related to the standardization of components and reduction in materials cost associated with box culverts. Specifically, in a first aspect of this invention, a single receiving channel is provided and specially designed to accommodate lower edge portions of box culverts extending at different angles relative to horizontal. In the preferred embodiment, the receiving channel is designed for receiving the lower edge of a box culvert at various angles relative to horizontal. The receiving channel of the invention includes a lower horizontal base, a lip extending upwardly along an outside edge for containing the box culvert within the channel and a taller curved member extending upwardly from the other edge of the base for supporting the box culvert at one of a plurality of angles. Fasteners, such as nuts and bolts, are used to secure the lower edge of the box culvert to the inside surface of the curved member.

In a second aspect of this invention, a culvert section is provided which reduces the material and manufacturing costs associated with the prior art culvert section mentioned above. Specifically, a culvert section of the present invention includes one less row of bolt holes and nut and bolt assemblies, yet still retains the same number of reinforcement ribs spaced the same distance apart when adjacent sections are bolted together. Specifically, while five rows of bolts and holes were required in the prior culvert section, for example, only four are necessary with the present invention. Ribs are fastened to opposite edges of the section and the same bolts are used to fasten adjacent edges of sections together. This has reduced both the manufacturing costs associated with the sections themselves since one less row of holes needs to be punched in each section and has also eliminated the need for one complete row of nuts and bolts associated with each section. These cost reductions can be significant considering the size and length of many box culvert structures.

Additional advantages of the invention will become more readily apparent to those of ordinary skill upon review of the following detailed description taken in conjunction with the accompanying drawings.

DETAILED DESCRIPTION OF THE PREFERRED EMBODIMENT

Figure 1:
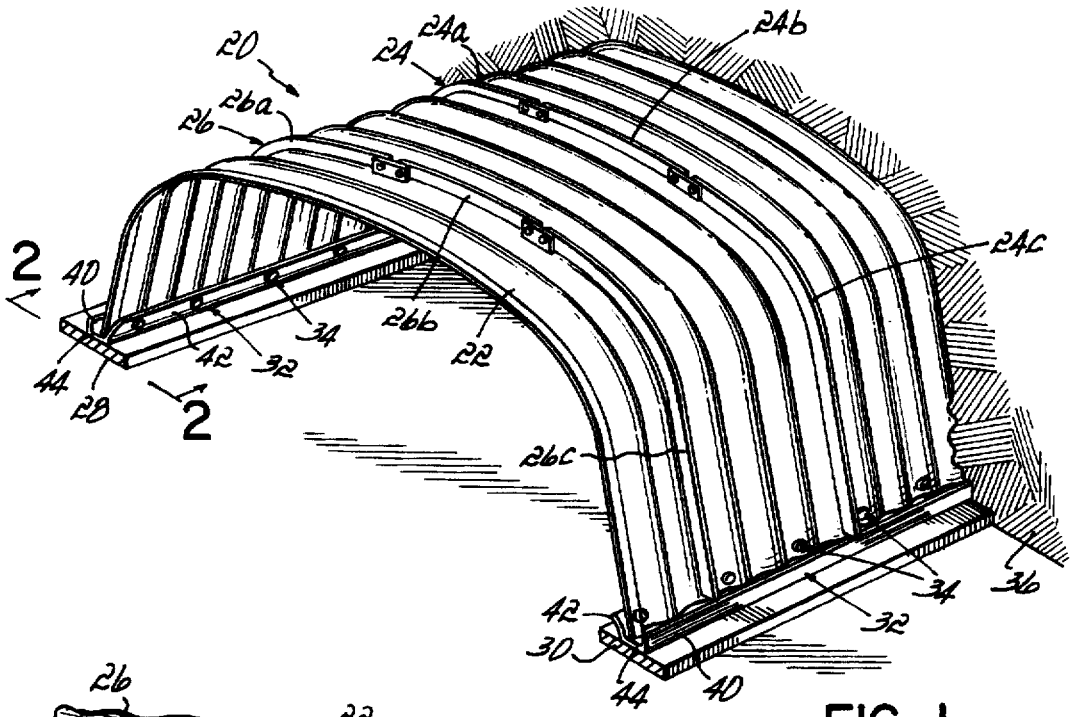
FIG. 1 is a perspective view of a box culvert structure constructed in accordance with the present invention.

Referring first to FIG. 1, a low head room culvert or box culvert 20 constructed in accordance with the present invention is shown and is generally manufactured from corrugated aluminum plate material 22 which has been formed into the curved shape shown. Although a single piece structure has been shown in FIG. 1 for clarity, the structure may be formed from separate corrugated plate sections as will be described further below. Not only are these plate sections overlapped and bolted together to form the culvert 20 with a desired length, but separate plate sections are also generally used to form the overall, curved cross-sectional shape of the culvert 20. In this regard, generally to form the entire cross-sectional shape, two curved side wall pieces are used and connected with an upper slightly curved top piece by bolts or other fasteners.

As also shown in FIG. 1, outer reinforcement ribs 24, 26 are also often used along the length of culvert 20 for applications requiring that culvert 20 have additional strength. Like culvert sections 22, each reinforcement rib 26 preferably is formed by three separate ribs 24*a*, 24*b*, 24*c* and 26*a*, 26*b*, 26*c*. The number of ribs 24, 26 will depend on the specific strength requirements of the application as well as the length of culvert 20, and only two are shown in FIG. 1. Ribs 24, 26 may be spaced from one another by, for example, 18 inches.

Still referring to FIG. 1, in many applications it is desirable to rigidly fix the base of the culvert to footing pads 28, 30 which may be formed of concrete. For this purpose, and in accordance with one aspect of the invention, an identical receiving channel or angle 32 is provided on each side of culvert 20, with each receiving channel 32 receiving and securing one longitudinal lower edge of culvert 20. As will be described further below, culvert 20 is secured to each receiving channel 32 by a plurality of fastener assemblies 34. Fill material 36, such as soil, is generally used to stabilize and secure the entire culvert structure 20 in place.

Figure 2A:
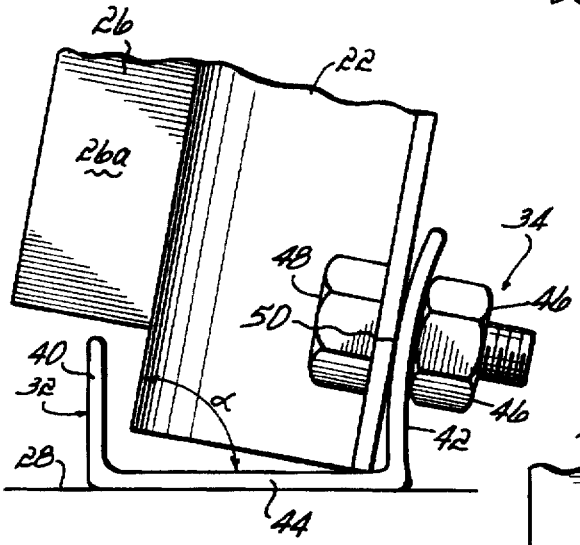
FIG. 2A is an enlarged view of the base of the box culvert as viewed along line 2—2 of FIG. 1 and showing the receiving channel of the present invention supporting the lower edge of the box culvert at a first angle $\alpha$.
Figure 2B:
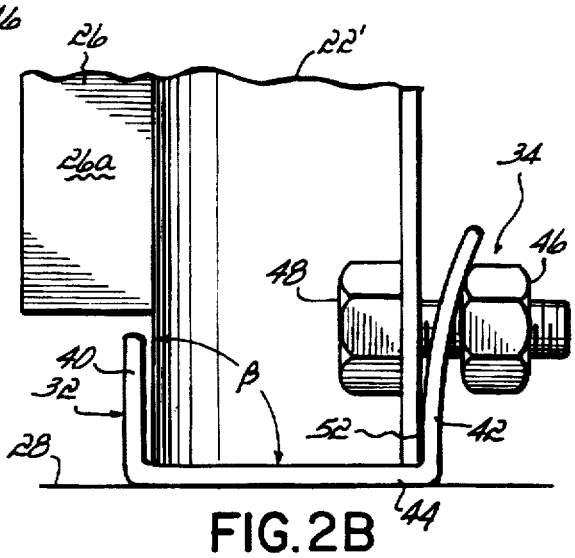
FIG. 2B is a view similar to FIG. 2A, but showing the receiving angle supporting the lower edge of the box culvert at a second angle $\beta$.

Referring now to FIGS. 2A and 2B, a universal receiving channel 32 constructed in accordance with the present invention is shown being used in two separate applications. Specifically, in FIG. 2A, receiving channel 32 receives a culvert section 22 which extends into receiving channel 32 at an angle $\alpha$, which may be 80° relative to horizontal, or in other words, relative to the upper surface of footing pad 28. In FIG. 2B, an alternatively designed culvert section 22' extends into the same receiving channel 32 at an angle $\beta$ which is 90° to horizontal or to the upper surface of footing pad 28.

In each of these applications, receiving channel 32 must fully support and secure the lower edge of culvert 20. The reason that receiving channel 32 of the present invention can secure the lower edge of either culvert section 22 or 22' relates to the cross-sectional shape of receiving channel 32. In this regard, receiving channel 32 includes an outer lip 40 and an inner curved leg 42 which each extend upwardly from a base horizontal portion 44. Base portion 44 is rigidly fixed to footing pad 28 or 30. Lip 40 preferably extends vertically upward with respect to base 44 while curved leg 42 curves generally outwardly from a lower edge thereof to an upper edge thereof and with respect to the interior of channel 32 which receives culvert section 22 or 22'. As will be appreciated from a review and comparison of FIGS. 2A and 2B, in each application a support surface area is provided on the inner surface of curved leg 42 when fastener assembly 34, and specifically nut 46 and bolt 48, are tightened as shown. In each application, there is surface area contact made as shown at 50 in FIG. 2A and 52 in FIG. 2B. Furthermore, upwardly extending lip 40 provides additional retaining structure for either culvert section 22 or 22'.

Figure 3:
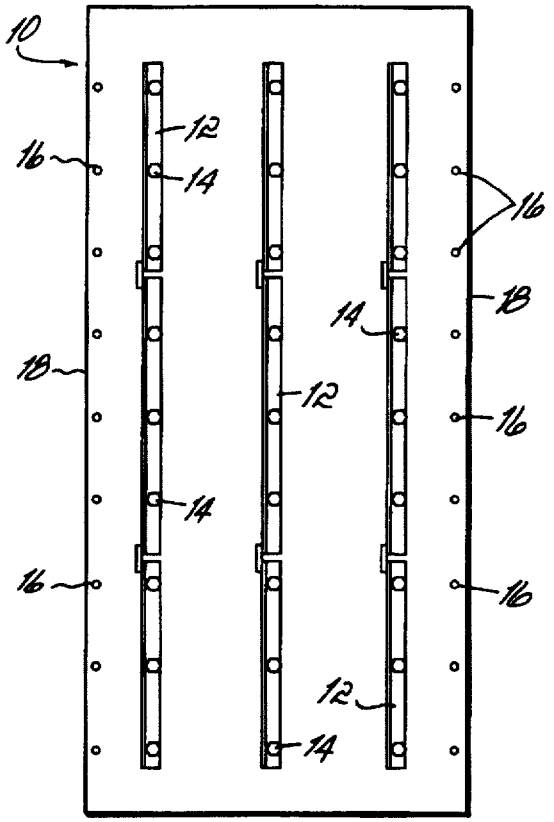
PRIOR ART FIG. 3
FIG. 3 is a developed top view of a culvert section of the prior art flattened out and not showing the conventional corrugated structure.
Figure 4:
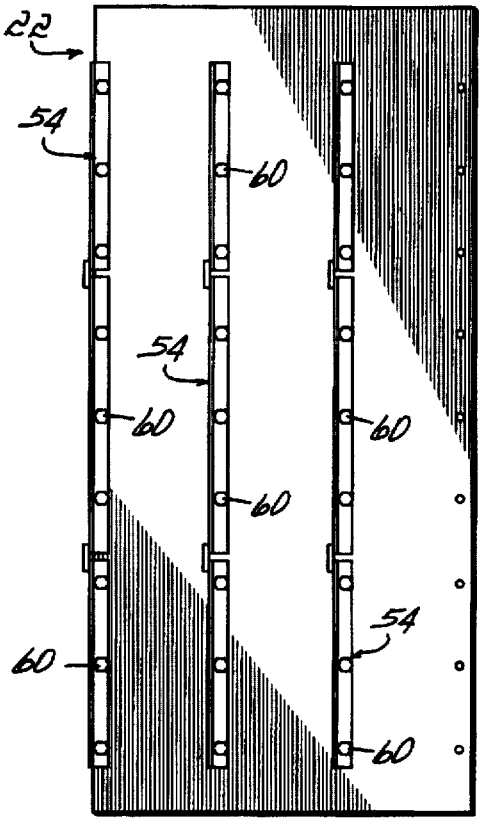
FIG. 4 is a developed top view similar to FIG. 3 but showing a culvert section and outer reinforcement rib configuration of the present invention.
Figure 5:
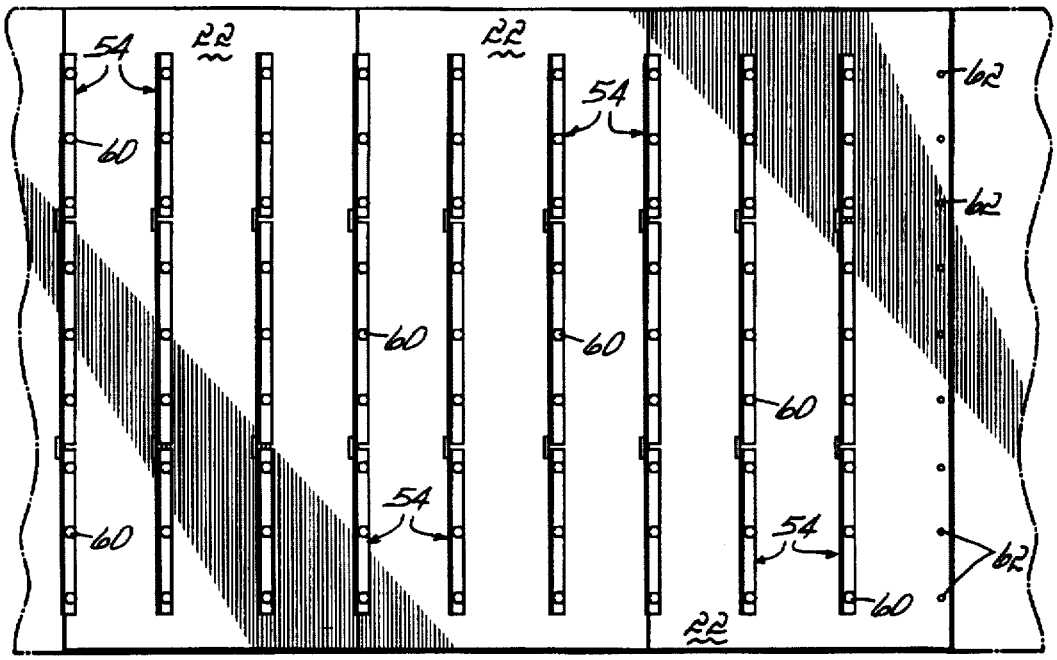
FIG. 5 is a developed top view schematically showing a plurality of culvert sections as shown in FIG. 4 bolted together as they are to form a box culvert according to the invention.

Referring to FIG. 4, another aspect of this invention relates to the reconfiguration of reinforcement ribs on each culvert section 22 with respect to the prior configuration shown in FIG. 3. In this regard, and as explained previously with regard to FIG. 3, it is generally desirable to space reinforcement ribs equidistantly along the entire length of culvert 20 (FIG. 1). In the example given, a spacing of 18 inches is used. Previously, as explained with respect to FIG. 3, one practice was to provide separate bolt holes 16 along each side each of a culvert section 10. Ribs 12 were bolted nine inches from each edge such that a spacing of 18 inches resulted when two culvert sections 10 were fixed together. As shown in FIG. 4, and in accordance with the present invention, the same spacing is provided between reinforcement ribs 54 while eliminating the need for one entire row of nut and bolt assemblies 60. Comparing FIGS. 3 and 4, it will be recognized that four rows of bolt holes are necessary in the present invention as opposed to five rows in the previous design. Each of the rows of bolt holes 62 (with three rows shown in FIG. 4 as having ribs 54 secured thereto) are spaced equidistant from each other and at the intended spacing of ribs 54. Thus, as shown in FIG. 5, when culvert sections 22 are overlapped at their edges and nut and bolt assemblies 60 are used to secure both ribs 54 to each culvert section 22 and, along the edges, to secure both ribs 54 to culvert sections 22 and adjacent culvert sections 22 to each other, proper rib spacing is achieved with a much lower overall number of nut and bolt assemblies 60 required. Also, as only four rows of bolt holes 62 need to be punched in each culvert section 22, lower manufacturing costs result.

While a detailed embodiment of the present invention has been described fully above, applicant does not intend to be bound by the details provided but only by the scope of the appended claims. Additional modifications and substitutions will become readily apparent to those of ordinary skill upon review of this detailed description without departing from the spirit and scope of the invention.

What is claimed is:

1. A culvert structure comprising:

an arch shaped corrugated culvert section having first and second lower edge portions;

at least one unitary receiving channel secured to said first lower edge portion, said receiving channel including a horizontal base member and a first inner upwardly extending arcuate member having curved support surface means for supporting said first lower edge portion thereon at a plurality of angles.

2. The culvert structure of claim 1 wherein the curved support surface of said receiving channel bears against an inner surface of said first lower edge portion.

3. The culvert structure of claim 1 wherein said receiving channel further includes a second outer upwardly extending member for containing said first lower edge portion along an opposite side of said first lower edge portion.

4. The culvert structure of claim 3 further comprising a footing pad which provides an attachment base for said at least one receiving channel.

5. The culvert structure of claim 4 wherein said second upwardly outer extending member extends substantially perpendicularly to an upper surface of said footing pad.

6. The culvert structure of claim 5 wherein the curved support surface of said receiving channel bears against an inner surface of said first lower edge portion.

7. The culvert structure of claim 1 further comprising two of said receiving channels, wherein one of said receiving channels is secured to each of said first and second lower edge portions.

8. The culvert structure of claim 7 wherein said receiving channels further include a second outer upwardly extending member, said curved support surface of said inner upwardly extending arcuate member of each receiving channel bearing against an inner surface of said culvert section and said second outer upwardly extending member being disposed outside of said lower edge portions of said culvert section.

9. The culvert structure of claim 8 wherein said receiving channels are secured to the first and second lower edge portions by fasteners extending through the arcuate members and the lower edge portions of said culvert section.

10. The culvert structure of claim 1 wherein said receiving channel is secured to said first lower portion by fasteners extending through the first inner upwardly extending arcuate member and through the first lower edge portion of said culvert section.

11. A receiving channel for securing a lower edge of a culvert, said receiving channel including a horizontal, flat base member and a first arcuate member extending generally upwardly from the base member and having curved support surface means for supporting said lower edge thereon at a plurality of angles.

12. The receiving channel of claim 11 further including a second upwardly extending member for containing said lower edge portion and disposed along an opposite longitudinal edge of said base member.

13. The receiving channel of claim 12 wherein a receiving space is defined between said first and second upwardly extending members and said curved support surface faces said receiving space and is curved outwardly from a lower edge to an upper edge thereof.

14. The receiving channel of claim 13 wherein said second upwardly extending member extends substantially perpendicularly to an upper surface of said base member.

15. A culvert structure comprising:

an arch shaped corrugated culvert section having first and second lower edge portions, each of said first and second lower edge portions extending downwardly at one of a plurality of angles;

at least one receiving channel secured to said first lower edge portion, said receiving channel including a horizontal base member and a first inner arcuate member extending upwardly from said horizontal base member, said first inner arcuate member having curved support surface means for supporting said first lower edge portion at said one of a plurality of angles.

16. The culvert structure of claim 15 wherein said receiving channel further includes a second outer member extending substantially perpendicularly from said horizontal base member, said first inner arcuate member and said second outer member containing said first lower edge portion therebetween wherein said curved support surface bears against an inner surface of said first lower edge portion.

17. The culvert structure of claim 15 wherein said at least one receiving channel is secured to the first lower edge portion at said one of a plurality of angles by fasteners extending through said first inner arcuate member and said first lower edge portion.

18. A culvert structure comprising:

an arch shaped corrugated culvert section having first and second lower edge portions, each of said first and second lower edges having an inner surface;

a unitary receiving channel secured to each of said first and second lower edge portions, said receiving channel including a horizontal base member and a first inner upwardly extending arcuate member having curved support surface means for supporting said inner surface of said first and second lower edge portions thereon at a plurality of angles.

19. The culvert structure of claim 18 wherein each of said receiving channels further includes a second outer member extending substantially perpendicularly from said horizontal base member, said first inner arcuate member and said second outer member containing said first and second lower edge portions therebetween wherein said curved support surface on each of said receiving channels bears against an inner surface of each of said first and second lower edge portions.

20. The culvert structure of claim 19 wherein the receiving channels are secured to the first and second lower edge portions at said one of a plurality of angles by fasteners extending through said first inner arcuate member of each of said receiving channels and said first and second lower edge portions.

* * * * *